US005722355A

United States Patent [19]

Ekdahl et al.

[11] Patent Number: 5,722,355

[45] Date of Patent: Mar. 3, 1998

[54] TWIN-PISTON ENGINE

[75] Inventors: Roy Ekdahl, Floda; Lars Larsson, Alingsås, both of Sweden

[73] Assignee: Aktiebolaget Electrolux, Stockholm, Sweden

[21] Appl. No.: 716,352

[22] PCT Filed: Mar. 31, 1995

[86] PCT No.: PCT/SE95/00344

§ 371 Date: Sep. 27, 1996

§ 102(e) Date: Sep. 27, 1996

[87] PCT Pub. No.: WO95/27129

PCT Pub. Date: Oct. 12, 1995

[30] Foreign Application Priority Data

Mar. 31, 1994 [SE] Sweden ..... 9401113
Mar. 31, 1994 [SE] Sweden ..... 9401114

[51] Int. Cl.[6] ..... F02B 25/12

[52] U.S. Cl. ..... 123/51 B; 123/51 BB; 123/52.5

[58] Field of Search ..... 123/51 B, 51 BB, 123/51 BD, 52.5, 52.2

[56] References Cited

U.S. PATENT DOCUMENTS

| | | | |
|---|---|---|---|
| 1,476,305 | 12/1923 | Toth | 123/51 B |
| 1,602,058 | 10/1926 | Violet | 123/51 B |
| 2,014,771 | 9/1935 | Mallory | 123/51 BB |
| 2,048,243 | 7/1936 | Zoller | 123/51 B |
| 2,133,510 | 10/1938 | Hallett | 123/51 B |
| 2,164,451 | 7/1939 | Fast | 123/51 B |
| 2,168,096 | 8/1939 | Ehrlich | 123/51 B |
| 2,234,918 | 3/1941 | Linthwaite | 123/51 B |
| 2,295,120 | 9/1942 | Maw | 123/51 B |
| 2,342,900 | 2/1944 | Sandell | 123/51 B |
| 2,706,970 | 4/1955 | Rinne | 123/51 B |
| 4,079,705 | 3/1978 | Buchner | 123/51 B |
| 4,275,689 | 6/1981 | Ray | 123/51 B |
| 4,296,714 | 10/1981 | Buchner | 123/51 BB |

FOREIGN PATENT DOCUMENTS

| | | |
|---|---|---|
| 397835 | 7/1994 | Austria . |
| 1434710 | 2/1966 | France . |
| 525073 | 10/1932 | Germany . |
| 573297 | 3/1933 | Germany . |
| 811515 | 8/1951 | Germany . |

*Primary Examiner*—David A. Okonsky
*Attorney, Agent, or Firm*—Pearne, Gordon, McCoy & Granger LLP

[57] ABSTRACT

A twin-piston engine (1), i.e., a crankcase scavenged two-stroke internal combustion engine comprising two pistons (2,3) travelling in essentially the same direction, and wherein one (4) of the cylinder bores, the exhaust bore (4), contains all exhaust ports (6), and the other cylinder bore (5), the scavenging cylinder bore, contains a number of scavenging ports (7,8,9). All suction ports (16) of the engine are positioned in the scavenging cylinder bore and a fuel supply device (20), such as a carburetor, is connected to the suction port/ports (16) and is positioned essentially on the line of extension (29) passing through the cross-sectional centers of the two cylinder bores whereas the exhaust port (6) is positioned essentially in alignment with the extension of that same line (29) in the opposite direction, and in that the mouth of the exhaust port (6) on the external face of the cylinder is provided with an essentially direct-mounted muffler (25) whereby the fuel supply device (20) and said muffler (25) will be positioned on opposite sides of the cylinder body.

13 Claims, 4 Drawing Sheets

TWIN-PISTON ENGINE

BACKGROUND OF THE INVENTION

1. Field of the Invention

The present invention relates to a twin-piston engine, i.e. a crankcase scavenged two-stroke internal combustion engine comprising two pistons travelling in essentially the same direction, and wherein one of the cylinder bores, the exhaust cylinder bore, contains exhaust ports, and the other cylinder bore, the scavenger cylinder bore, contains a number of scavenging ports.

2. Description of Related Art

So called twin-piston engines have been known for some time. Since the scavenging ducts and the exhaust duct are positioned in a different one of the cylinder bores, the scavenging gas losses in the exhaust port are smaller than in conventional two-stroke engines. The result is lower fuel comsumption and cleaner exhausts than in the case of a conventional two-stroke engine. However, it is known that this advantage is greatest when the delivery rates are low. The delivery rate is the amount by weight of scavenging gas supplied to the combustion chamber divided by the maximum amount by weight of scavenging gas that may be contained in the combustion chamber. Higher delivery rates thus result in increased engine power. For this reason it is desirable to provide for low fuel consumption also when the delivery rates are those normally found in a two-stroke engine. A reduction of the engine scavenging losses leads both to a lower fuel consumption and to considerably reduced exhaust emissions.

In portable utility appliances crankcase scavenged engines are used as a rule because their lubricating system is independent of position and handling. It is a great deal more difficult to create an efficient enaging design in the case of crankcase scavenged double-piston engines than in the case of non-scavenged engines. This is due to the fact that the scavenging ducts from the crank-case compete with the suction port for the available space in the cylinder wall when that port is positioned in the scavenging cylinder bore, a position which is often desirable. The difficulties are most pronounced when open scavenging ducts, such as diecast scavenging ducts, are used. Examples of twin-piston engines of the non-crankcase scavenged type are provided by U.S. Pat. Nos. 1,476,305; 1,968,524; and 1,777,478.

Prior-art crankcase scavenged twin-piston engines often have a complex and bulky construction while at the same time the fuel efficiency leaves a great deal to be desired. In addition, they are difficult to manufacture in a rational way and their suction and exhaust ducts are often placed in closely adjacent relationship, resulting in unsuitable heating of the suction side. Examples of such prior-art twin-piston engines are found in U.S. Pat. Nos. 1,265,596, 1,542,697, DE 573 297, and DE 570 786. These publications show arrangements wherein the suction and exhaust ducts are positioned closely adjacent each other, positioned in the same cylinder bore, V-shaped cylinder bores, etc.

SUMMARY OF THE INVENTION

An object of the present invention is to substantially reduce the problems in the art by providing a twin-piston engine of a simple and purposeful construction which exhibits a high fuel efficiency, particularly at delivery rates that normally are found in a twostroke engine.

In accordance with the present invention all suction ports of the engine are positioned in the scavenging cylinder bore.

A fuel supply device, such as a carburettor, is connected to the suction port/ports and is positioned essentially on the line of extension passing through the cross-sectional center of the two cylinder bores. The exhaust port is positioned essentially in alignment with the extension of that same line in the opposite direction. The mouth of the exhaust port debouching on the external face of the cylinder is provided with an essentially direct-mounted muffler whereby the fuel supply device and said muffler will be positioned on opposite sides of the cylinder body. The following reasoning is applicable with respect to an engine that corresponds to a conventional single-cylinder two-stroke engine. An analoguous line of reasoning is applicable to multi-cylinder engines wherein each cylinder of the conventional engine has its equivalence, in the twin-piston engine, in two cylinder bores with co-operating pistons.

Owing to this structure, one warm and one cold side are created on opposite sides of the cylinder body, thus preventing the exhaust heat from affecting the suction side including e.g. a carburetor. This is a definite advantage. Preferably, the suction port is configured in such a manner that laterally it surrounds a scavenging port and/or an associated scavenging duct. In addition, the two cylinder bores preferably are formed with different stroke volumes. The scavenging cylinder bore preferably should have a larger bore area and/or a longer stroke than the exhaust cylinder bore in order to reduce the scavenging losses. Preferably, the cylinder bores are arranged in parallel relationship and the scavenging cylinder bore is provided with open scavenging ducts to allow the cylinder body to be formed in a die-cast operation. These and other characteristics and advantages of the invention will be apparent from the ensuing description of preferred embodiments and with the support of the drawing figures.

BRIEF DESCRIPTION OF THE DRAWINGS

The invention will be described in closer detail in the following by way of various embodiments thereof with reference to the accompanying drawing figures wherein.

DETAILED DESCRIPTION OF A PREFERRED EMBODIMENT

Figure 1:
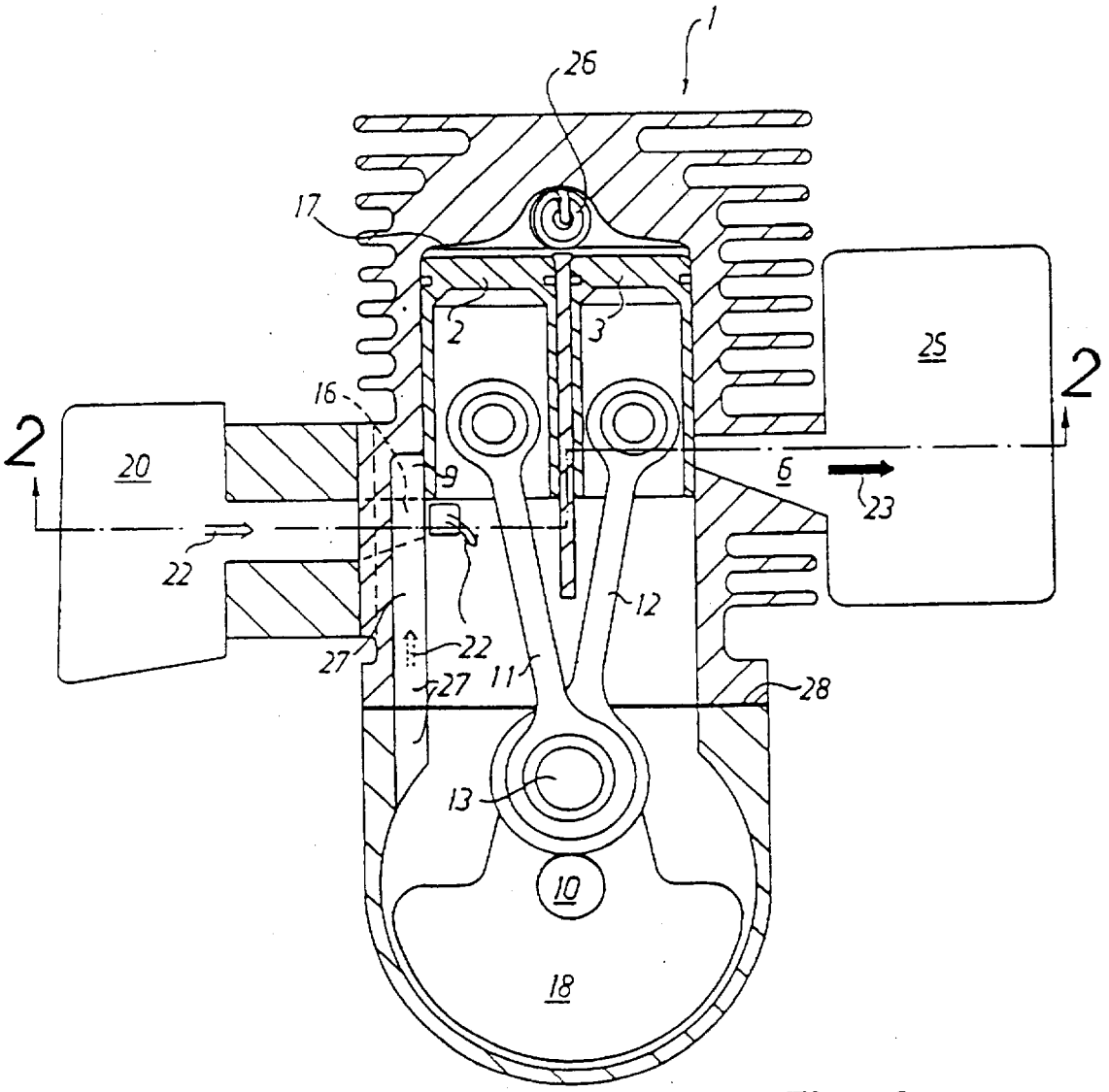
FIG. 1 is a cross-sectional view of a twin-piston engine in accordance with the invention. The section is taken along line B—B in FIG. 2.
Figure 2:
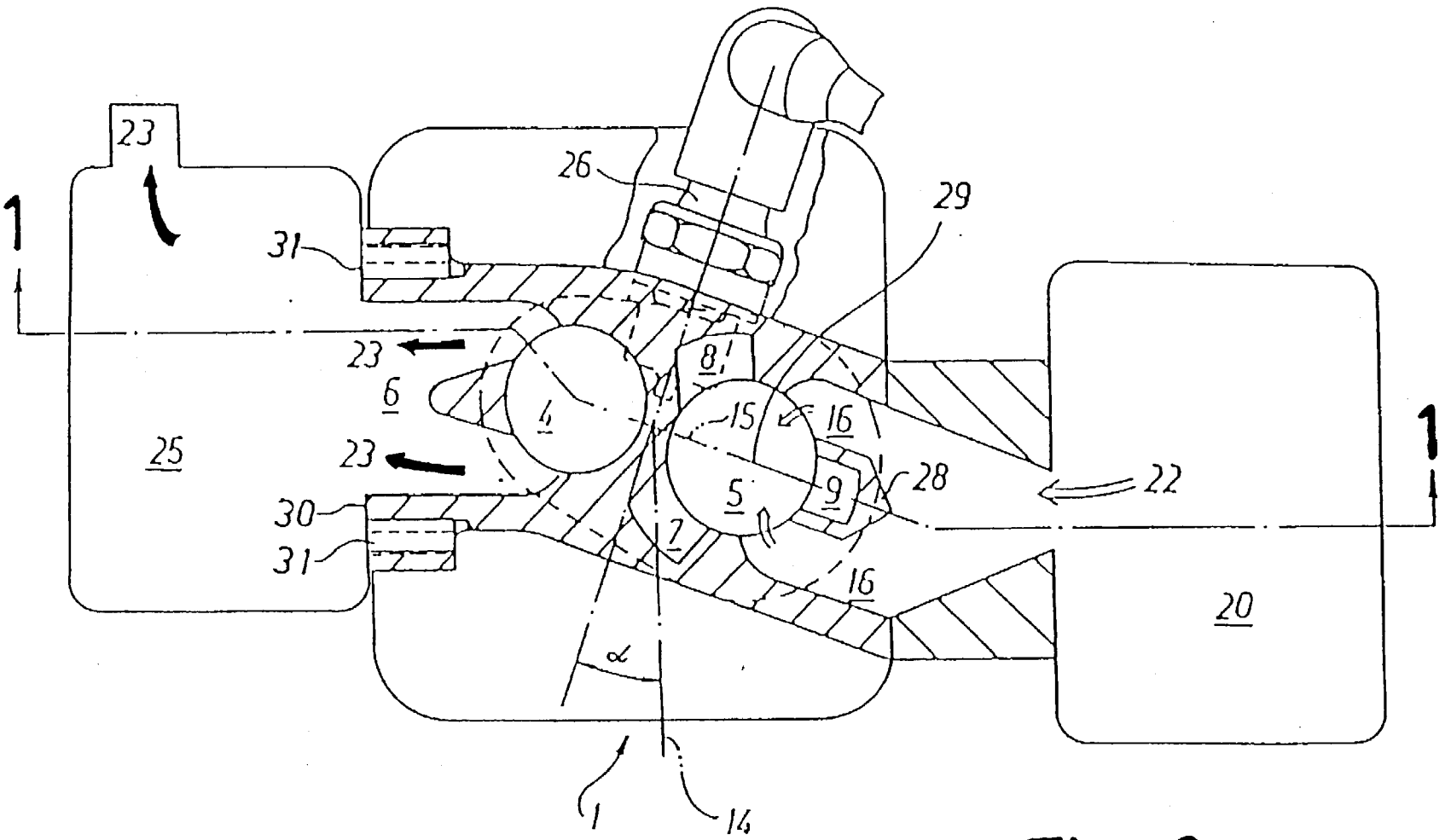
FIG. 2 is a cross-sectional view of the twin-piston engine in accordance with FIG. 1. The section is taken along line A—A in FIG. 1. In this cross-sectional view the engine thus is viewed from below in the longitudinal direction of the cylinders, towards the spark plug.
Figure 3:
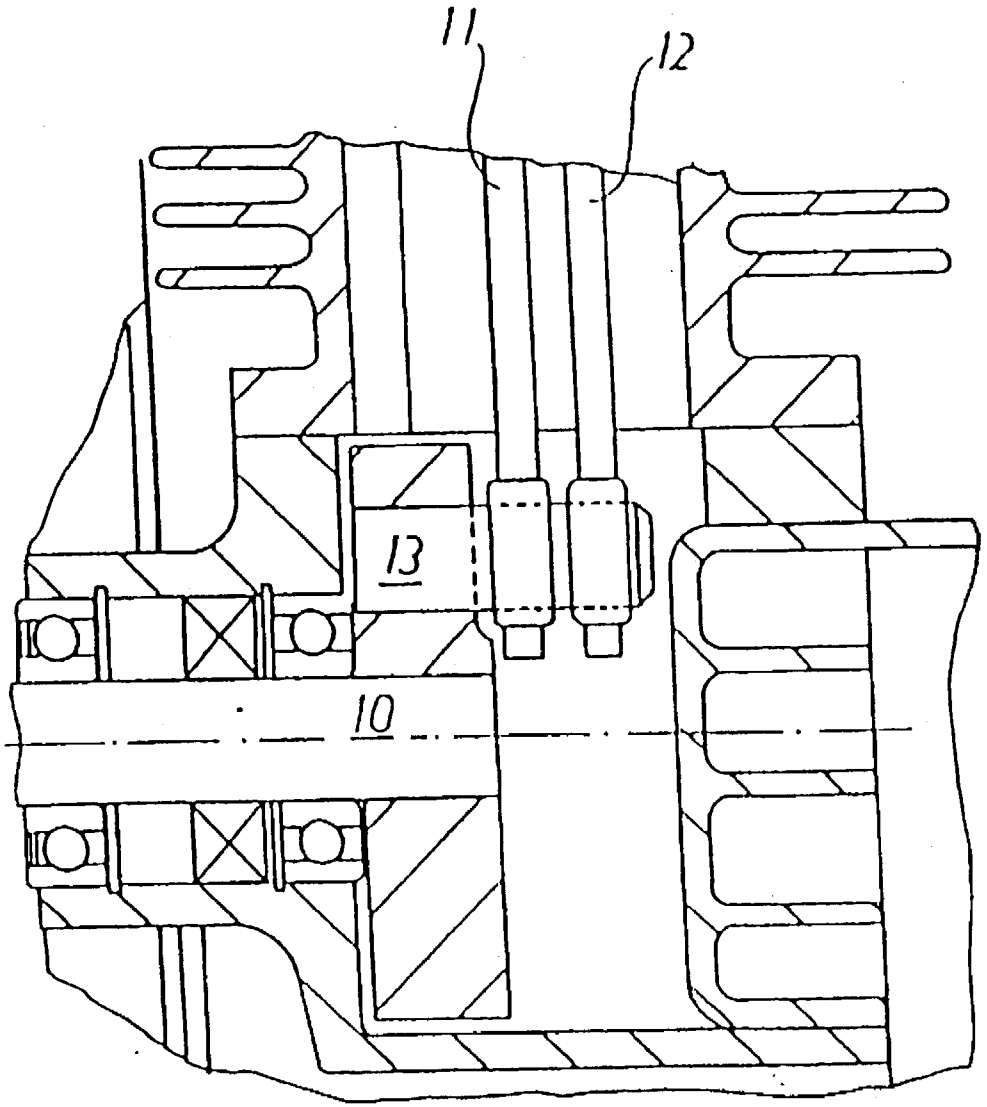
FIG. 3 is a partial cross-sectional view of the twin-piston engine in accordance with FIG. 1. As seen from the side in FIG. 1, the engine crankshaft portion is shown in a cross-sectional view.

FIGS. 1, 2 and 3 show a so called twin-piston engine in a cross-sectional view. The engine has two pistons 2, 3 operating in its respective one of neighbouring cylinder bores 4, 5. By means of its connecting rod 11 and 12, respectively, the two pistons are connected with a common crank pin 13 which is secured to a crank member 18 including a counter-weight. The crank member 18 is in turn secured to the crank-shaft 10. In the position illustrated in the drawing figures the two pistons assume a position approximately at their respective top dead center. Consequently, they will move together downwards and turn the crankshaft 10. From a carburettor or fuel injection device 20 an air-fuel mixture 22 is fed into one 5 of the cylinder bores. The suction port 16 is of a particular configuration. Thus, as shown in the drawing figures, the suction port is divided into two sections along part of its longitudinal extension, these two sections laterally surrounding a scavenging port 9 or a scavenging duct 27. In accordance with FIG. 1 the air fuel mixture from the carburettor or the fuel injection means 20 thus is divided into one fraction passing behind the plane of the paper sheet and appearing where indicated by an arrow 22 and one fraction passing in front of the plane of the paper sheet and not visible. A comparison with FIG. 2 will make this clear. The suction port 16 thus is designed in such a manner that in the cylinder it debouches on either side of a scavenging port. In contrast, its suction duct merges upstream into one part. The latter is fed with an air-fuel mixture from a carburettor or a fuel injection system. In other words, the suction port could be regarded as straddling a scavenging port and/or an associated scavenging duct. Owing to this construction it becomes a great deal more simple to achieve a sufficient total area of the suction port while at the same time the suggested solution facilitates the choice of a favourable configuration of the scavenging ports. For instance, three scavenging ports may be used and the suction port may laterally surround the rear scavenging port 9 or the auxiliary port 9. In this case three ports are used, two larger and one smaller auxiliary port. They may be equally distributed in the cylinder, which is an advantage. The suction port 16 then surrounds the smaller auxiliary port 9. This arrangement results on the one hand in a favourable configuration of the scavenging port and on the other in a favourable control or support of the piston, ensuring that evenly distributed control faces exist arround the cylinder wall. This is particularly important when die-cast scavenging ducts are used. To be able to die-cast the cylinder and the scavenging ducts is a very favourable possibility from an economical point of view. A condition for this arrangement is that the two cylinder bores 4, 5 are mutually parallel. In this case, the scavenging duct 27 is open along its entire longitudinal extension towards the cylinder, resulting in straddling of a scavenging port and/or a scavenging duct associated with such an open scavenging duct.

When die-cast scavenging ducts are used each scavenging duct is designed as a groove in the cylinder wall and this groove extends from the port position all the way down into the crankcase. Thus, the scavenging duct competes for the available space also with the suction port placed in a lower position. This could to some extent be avoided in not-die-cast scavenging ducts by positioning the scavenging ducts further outwards from the cylinder wall. The straddling suction port 16 thus is particularly advantageous in die-cast (open) scavenging ducts. One important advantage is that an efficient suction port having a large area may be combined with scavenging ducts. Applicants do not know of any prior-art twin-piston engine incorporating this feature.

In accordance with standard language usage the scavenging duct 27 leads from the crankcase up to the part, the scavenging port 9, of the scavenging duct 27 that debouches into the cylinder bore. In this case the scavenging duct 27 is die-cast in the same operation as the two cylinder bores. In this manner the cylinders and the scavenging ducts may be manufactured in a highly rational manner. It also means that core slides used in the die-casting are extracted in the downward direction, i.e. towards the crankcase. Consequently, the scavenging ducts will be open in the direction facing the piston along their entire longitudinal extension in the cylinder part. The joint between the cylinder portion and the crankcase portion is designated by reference 28 in the drawing figure. When open scavenging ducts are used the upper part thereof, positioned above the piston when the latter assumes its bottom dead center position, is suitably denominated scavenging port, the reason therefor being that it is precisely through this upper part that communication is established into the combustion chamber. As appears from FIG. 2 the twin-piston engine comprises three scavenging port 7, 8 and 9. Each has an associated scavenging duct, having an appearance similar to that of scavenging duct 27 illustrated in FIG. 1. The scavenging ducts are open towards the piston. All scavenging ports 7–9 are arranged in one of the cylinder bores, the scavenging cylinder bore 5, whereas the exhaust port 6 is arranged in the other cylinder bore 4. In this manner leaks of the air-fuel mixture 22 from the scavenging port to the exhaust port 6 are minimized. The result is a lower fuel consumption and cleaner exhausts than in the case of conventional two-stroke engines.

Otherwise, the twin-piston engine in accordance with FIGS. 1–3 function in the same way as a conventional two-stroke engine. Consequently, the air-fuel mixture 22 flows towards the crankcase and then, via the scavenging duct 27 including scavenging port 9 and the rest of the scavenging ducts and ports it reaches the combustion chamber 17. Arrow 22 is drawn in broken lines since this flow occurs only after the piston having descended sufficiently far down to expose the upper part of the scavenging duct 27, port 9. Consequently, the combustion chamber is common to both cylinder bores and is served by one common spark plug 26. The engine exhausts 23 exit through exhaust port 6 to a muffler 25. The latter is mounted directly on the cylinder with the aid of an attachment shoulder 30 including two screw holes 31 formed at the exhaust-duct mouth on the external face of the cylinder. This arrangement is a very compact one but obviously the muffler could also have been mounted with the aid of an intermediate spacer element. Preferably, a cooling fan is used. In this case the fan impeller is mounted on the crankshaft extension, to one side a of the engine body, i.e. along line 14 or its extension.

As appears from FIG. 2 the suction means including the carburettor 20 or the fuel injection system will be positioned on the opposite side from that of the exhaust portion including the muffler 25. This is advantageous since one warm and one cold side are created and the associated components will be positioned on opposite sides of the cylinder block. However, it is also advantageous with respect to the die-casting of the cylinder block. The core slide members corresponding to the suction port 16 and to the exhaust port 23, respectively are extracted in approximately mutually opposite directions and the slides corresponding to the cylinder block cooling fins are extracted transversally to that direction.

As mentioned previously the twin-piston engine in accordance with the invention has its scavenging ports 7–9 formed in one cylinder bore and its exhaust port 6 in the other cylinder bore, which minimizes leaks of air-fuel mixture 22 from the scavenging ports to the exhaust port 6. Leaks are also affected by the stroke volume of the associated cylinder bore and by any phase difference between the piston motions.

The concept "phase difference" may be explained in closer detail with reference to FIGS. 1 and 2. For reasons of clarity, a cross-section along line B—B has been chosen. The cross-section is taken between the centers of the two cylinder bores 4, 5 and further in a direction out through one scavenging duct 9. In the opposite direction the cross-section passes from the center of the cylinder bore 4 and out through one branch of the exhaust port 6. In the outer portions of, respectively, the exhaust port 6 and the suction port 16, the crosssection passes transversally with respect to the engine unit. It should be noted that the engine crankshaft extends along line 14 in FIG. 2. Consequently, there is an angular difference α between the rotational shaft 14 and a line at right angles to the line passing through the center of the two cylinder bores 4, 5. The angle α affects the phase difference between the piston motions. FIG. 1 is simplified in the respect that the crank part of the engine, i.e. below the partition line 28, is not shown in the oblique direction but in the general direction of section B—B. Angle α may vary between 0° and 90°. When angle α is 90°, i.e. when the crankshaft rotational axis runs below the center line between the cylinder bores the phase difference is zero. On the other hand, when α is 0° phase difference is at its maximum.

Consequently, the phase difference in this case arises because the angle α is 0° or comparatively small, compare FIG. 1, and because the connecting rods 11, 12 operate on the same crank pin 13. In accordance with the embodiment of the invention illustrated in the drawing figures the center of the crankshaft 10 lies straight below the partition wall between the two cylinder bores. The figure illustrates a rotational position when the shaft pivot lies straight above the crankshaft center. In this position, each piston 2, 3 is close to but not exactly at their top dead center. The dead center of piston 2 approximately corresponds to a position of the crank pin 13 somewhat to the left of the one illustrated in the drawing figure whereas, with respect to piston 3, it is somewhat to the right of the position illustrated. When the crankshaft is rotated, one piston thus approaches towards its dead center whereas the other one moves away from it. It is this phase difference in the movements of the pistons that is an essential aspect of the invention. By moving the center of the crankshaft 10 laterally, the phase difference could be redistributed between the two pistons in such a manner that when it increases with respect to one of them it lessens with respect to the other and vice versa. Also the length of the connecting rods affects the magnitude of the phase difference. Short connecting rods produce in a larger phase difference than do long connecting rods. In accordance with the embodiment illustrated the crank pin 13 is completely cylindrical. This means that the two connecting rods 11, 12 have a common crank pin center and could be of identical configuration, as appears from FIG. 3. However, each connecting rod 11 and 12 could also be mounted on one crank pin each. The mutual distance between the crank pins in this case affects the phase difference, normally in such a way as to reduce the latter. If the distance from the center of each crank pin 13 to the center of the crankshaft 10 is made to be equal with respect to each connecting rod and piston, the stroke lengths of the associated pistons could be made equal. This means that, for instance, piston 2 can be given a larger stroke length than the piston 3 whereby the stroke volume of piston 2 will be larger than the stroke volume of piston 3, also when the two cylinder bores 4, 5 have an equal bore area. It likewise becomes possible to arrange a common crank pin 13 in such a manner that this effect will be achieved. In this case it is suitable to form the crank pin 13 with a larger diameter with respect to connecting rod 11 and a smaller diameter with respect to connecting rod 12. These two diameters then will have different centers.

Figure 4:
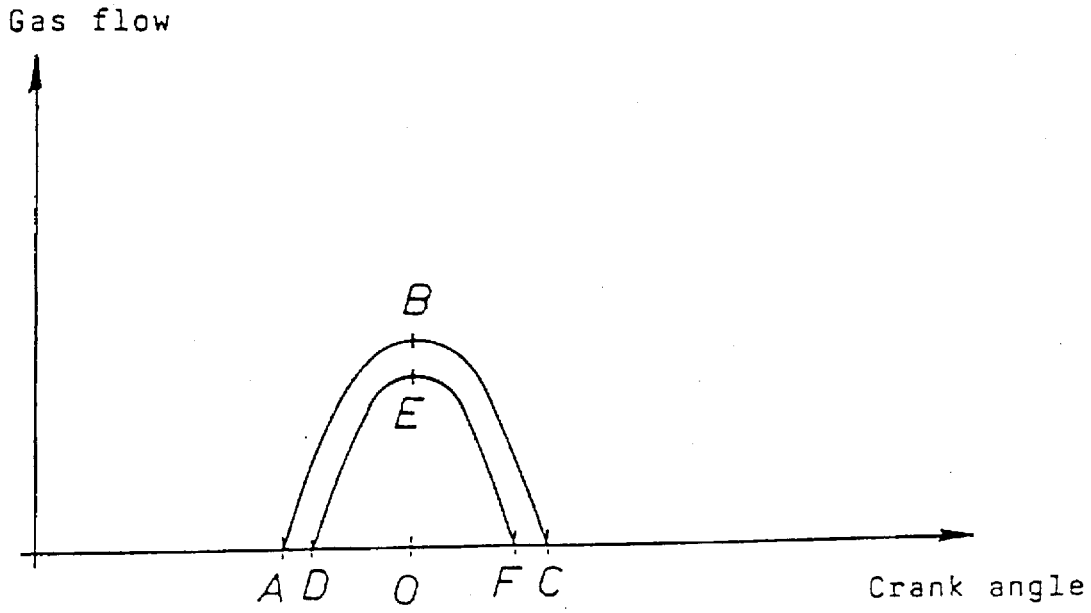
FIG. 4 illustrates the gas flow through exhaust ports (A-B-C) and through scavenging ports (D-E-F) in a conventional two-stroke engine.
Figure 5:
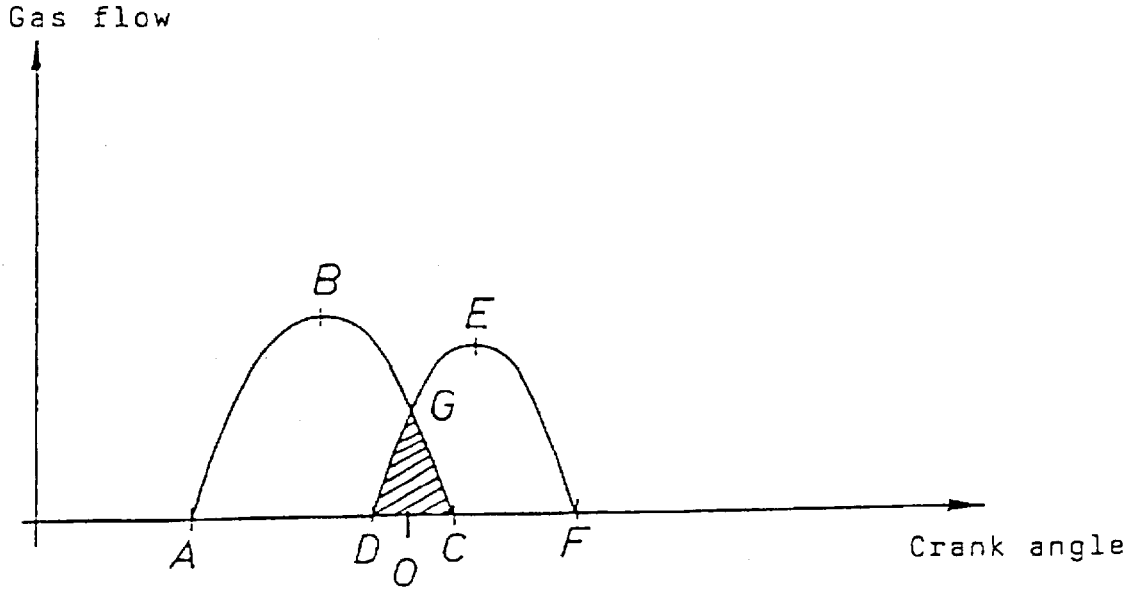
FIG. 5 illustrates the same gas flows as in FIG. 4 but relating to a twin-piston engine.

FIGS. 4 and 5 illustrate gas flows through the exhaust port, curve A-B-C, and through the scavenging ports, curve D-E-F with respect to on the one hand a conventional two-stroke engine in FIG. 4 and a twin-piston engine in FIG. 5. The lower dead center is indicated by 0. As appears from FIG. 4 the two curves are centered with respect to the lower dead center 0. This is due to the fact that scavenging as well as exhaust emissions are controlled by the same pistons. In the twin-piston engine on the other hand, according to FIG. 5, the two flow curves are displaced with respect to one another. This is made possible because each flow is controlled by its associated piston. As illustrated in FIG. 5 the curve representing the exhaust flow has been moved forwards whereas the curve representing the scavenging flow has been moved back with relation to the lower dead center 0. The two curves overlap by crank angle D-C. The "triangular" area D-G-C is a measure of the simultaneous gas flows. In the conventional engine in FIG. 4 the corresponding area comprises all of D-E-F. The distance B-E is a measure of the phase difference. Preferably it amounts to between 15 and 30 crank angle degrees.

Thus, the twin-piston engine is adopted so that the desired phase difference between the piston motions is achieved. The desired phase difference is, as already mentioned, between 15° and 30°. Suitably, this is achieved by combining a comparatively small angle α according to FIG. 2 with short connecting rods. Angle α preferably is chosen to between 10° and 40° and preferably to about 25°. This means that the desired phase difference could be achieved by using short connecting rods, resulting in a unit of small structural height, which is desirable.

As mentioned, the twin-piston engine has a low fuel consumption compared with conventional two-stroke engines. This is due to the fact that the scavenging losses, i.e. scavenging gas losses into the exhaust system are small. The so called trapping efficiency defines the proportion of the scavenging gas actually retained in the combustion chamber and utilized in the combustion. In the twin-piston engine the trapping efficiency is a good 0.9 for normal engine data. This means that the scavenging gas losses are approximately 10%. This volume should be compared with that in the case of a conventional two-stroke engine having a trapping efficiency of approximately 0.75 and thus scavenging losses of approximately 25%. By forming the scavenger cylinder bore 5 with a large stroke volume than the exhaust cylinder bore 4 it becomes possible to increase the trapping efficiency and thus to reduce the scavenging losses. The increased volume of the scavenger cylinder bore results in a smaller fraction of the scavenging gas being transferred to the exhaust cylinder bore during scavenging. Scavenging takes place when the pistons are in a descended position, close to their lower dead center. When the stroke volume in the scavenging cylinder bore is larger the leaks of scavenging gas through the exhaust port quite simply are reduced. Essentially this stroke volume difference is achieved by the different bore areas in the two cylinder bores. However, it could also be created or be reinforced by a stroke length difference of the two pistons. By making use of different size stroke volumes of the two cylinder bores it thus becomes possible to reduce the fuel consumption. This effect is reinforced by a careful choice of phase difference between the motions of the two pistons, as mentioned earlier. Totally, it thus then becomes possible to reduce the scavenging losses considerably so as to obtain trapping efficiency values of up to 0.96–0.98. This is a definite improvement compared with a conventional twin-piston engine. Particularly, the exhaust gases become considerably cleaner. A further advantage is that a smaller cylinder is more able to cope with the temperature problems arising at the exhaust port. This means that the risk of piston seizing is reduced because the exhaust cylinder bore has been given a smaller bore area.

It is also worth noting that it is quite possible to proceed in the opposite direction, i.e. to make the exhaust cylinder bore larger than the scavenger cylinder bore. This does not, however, result in the above-mentioned reduction of the fuel consumption and of exhaust emissions compared with a conventional twin-piston engine. On the contrary, a certain increase takes place. But in certain applications it could all the same be of interest to configure an engine of this kind. It could still reach trapping efficiency of about 0.9, i.e. a considerable improvement over a conventional two-stroke engine. For instance, it might be possible to use a narrow scavenging cylinder bore having only between 10 and 20% of the total bore area. In this case the scavenging cylinder functions as a feeder system supplying the exhaust cylinder bore or the principal cylinder. This solution could be regarded as a simplification compared with a solution including a suction valve.

When the crank shaft 10 is uniliterally mounted, compare FIG. 3, and the two connecting rods 11, 12 are mounted on the same crank pin 13, the connecting rod 12 and its associated piston 3 used in the narrower cylinder bore 4, is mounted at the extreme end of the crank pin 13. This reduces the stress on the crank pin 13.

We claim:

1. A twin-piston engine (1) comprising a scavenging cylinder bore (5) and an exhaust cylinder bore (4), a scavenging piston (2) disposed within said scavenging cylinder (5) and an exhaust piston (3) disposed within said exhaust cylinder (4), said pistons (2,3) travelling in essentially the same direction, said exhaust cylinder bore (4) including an exhaust port (6), and said scavenging cylinder bore (5) including a plurality of scavenging ports (7,8,9), wherein a suction port (16) of the engine is positioned in the scavenging cylinder bore (5) and a fuel supply device (20) is connected to the suction port (16), said suction port being essentially symmetrical relative to a line of extension (29) passing through cross-sectional centers of the two cylinder bores whereas the exhaust port (6) is positioned near an extension of said line of extension (29) but on an opposite side of said cylinders relative to said suction port and wherein at least one scavenging duct (27) is open towards the scavenging piston (2) along its entire longitudinal extension in the cylinder from the scavenging port (7,8,9) to a point (28) between the cylinder and a crankcase portion.

2. A twin-piston engine (1) according to claim 1, wherein the scavenging duct (27) is open towards the scavenging piston (2) along its entire longitudinal extension in the scavenging cylinder.

3. A twin-piston engine (1) according to claim 1, wherein the scavenging duct is formed in the die-casting of the scavenging cylinder.

4. A twin-piston engine (1) in accordance with claim 1, wherein the suction port (16) laterally straddles one of said scavenging ports (7,8,9) or said scavenging duct (27).

5. A twin-piston engine (1) according to claim 3, wherein the suction port (16) laterally straddles an auxiliary scavenging port (9).

6. A twin-piston engine (1) according to claim 1, wherein a mouth of the exhaust port (6) debouching on an external face of the exhaust cylinder is provided with an essentially direct-mounted muffler (25).

7. A twin-piston engine (1) according to claim 1, wherein the two cylinder bores (4,5) are parallel to one another.

8. A twin-piston engine (1) according to claim 1, wherein the scavenging cylinder bore (5) has a first stroke volume capacity and the exhaust cylinder bore has a second stroke volume capacity, said first stroke volume capacity being different than said second stroke volume capacity.

9. A twin-piston engine (1) according to claim 8, wherein the scavenging cylinder bore (5) has a first bore area and the exhaust cylinder bore (4) has a second bore area, said first bore area being different than said second bore area.

10. A twin-piston engine (1) according to claim 1, further comprising a connecting rod and a crankshaft, said connecting rod and crankshaft (10–13) being arranged as so to produce a controlled phase difference between movement of the two pistons (2,3), the phase difference being due to adjustment of the lengths of the two connecting rods (11,12) and to the connecting rods having mutually different crank pin centers, and/or due to the deviation of the crankshaft rotational axis (14) from perpendicular by an angle "a" from a common plane which extends axially through the two cylinder bores (4,5) such that a phase difference of 15°–30° of crank angle exists between the respective piston movements.

11. A twin-piston engine (1) according to claim 10, wherein the angle "a" is about 25°, the connecting rods have a comparatively short length which contributes to the phase difference, and the two connecting rods have a common pin center.

12. A twin-piston engine (1) according to claim 10, wherein when the crankshaft (10) is mounted unilaterally and the two connecting rods (11,12) are mounted on the same crank pin (13), the connecting rod (12) together with the exhaust piston (3) being mounted at an extreme end of the crank pin (13).

13. A twin-piston engine (1) according to claim 3, wherein the suction port (16) laterally straddles an associated scavenging duct (27), which is open towards the scavenging piston (2), along its entire longitudinal extension in the scavenging cylinder.

* * * * *